United States Patent [19]

Lorenz

[11] 4,184,524

[45] Jan. 22, 1980

[54] MOUNTING FOR CENTRIFUGE FILLING DEVICE

[76] Inventor: Peter R. Lorenz,
Georg-Speyer-Strasse 79, D-6000
Frankfurt, Fed. Rep. of Germany

[21] Appl. No.: 942,694

[22] Filed: Sep. 15, 1978

[30] Foreign Application Priority Data

Nov. 4, 1977 [DE] Fed. Rep. of Germany ..... 2749367

[51] Int. Cl.[2] ..... B65B 3/00; B04B 15/00

[52] U.S. Cl. ..... 141/392; 233/1 R; 233/1 C; 248/313

[58] Field of Search ..... 141/392, 375, 376; 233/14 R, 1 C, 1 R; 248/258 R, 94, 312, 313

[56] References Cited

U.S. PATENT DOCUMENTS

| | | | |
|---|---|---|---|
| 577,829 | 2/1897 | Brown | 248/94 |
| 1,408,184 | 2/1922 | Farlow | 248/313 X |
| 2,458,329 | 1/1949 | Archer | 248/313 X |
| 4,069,968 | 1/1978 | Herman | 233/14 R |

*Primary Examiner*—Frederick R. Schmidt
*Attorney, Agent, or Firm*—Curtis, Morris & Safford

[57] ABSTRACT

A mounting arrangement for reducing vibrations of the filling device in a centrifuge comprises a pair of wing members of predetermined configuration adapted to be pivotably connected together on the rotor shield of a centrifuge to define a space therebetween which is adapted to receive a filling device of the centrifuge. The wings each have a plurality of radially inwardly extending resilient bumpers adapted to engage a filling device to resist vibrations therein.

7 Claims, 6 Drawing Figures

MOUNTING FOR CENTRIFUGE FILLING DEVICE

The present invention relates to centrifuge devices, and in particular, to a device for reducing vibrations in the filling device of a centrifuge.

The purification of large quantities of virus antigens can be effected by the gradient centrifuging of a specimen in a so-called "zonal rotor." In such devices, in order to develop the gradient within the specimen, after centrifuging, not to destroy the gradient upon the removal of fractions, loading and unloading are effected with the rotor operating at a relatively low speed of rotation. For this purpose, it is necessary to use a filling device or connection which contains a rotatable seal or bearing to form the connection between the filling device and the rotating chamber containing the gradient specimen.

Centrifuging of specimens in such apparatus is normally done at high speeds of up to 75,000 rpm. However, for the purpose of filling and emptying the rotor, the centrifugal speed is reduced to about 3000 rpm. At this speed, the filling device can also be connected and disconnected from the centrifuge.

The typical connection between the filling device and rotating element in the centrifuge is formed by a bayonet mount between the filling device and a fixed structure in the centrifuge apparatus. The bottom of the filling device includes a rotating seal or bearing which contacts and turns with the rotating element of the centrifuge while the remainder of the filling device remains held in a relatively fixed position. During use of the apparatus however with the so-called "Z-60" rotor, of the type available from Beckman Instruments, the filling device includes an elongated transfer shaft. These shafts produce a greater lever action which results in increased vibrations that could damage the rotating seal or bearing, and thus produce leaks.

It is an object of the present invention to resist and reduce vibrations in the filling device of a zonal type centrifuge.

Another object of the present invention is to provide a mounting device for the filling device of centrifuges which will reduce vibrations in the filling device.

A still further object of the present invention is to provide a vibration resisting mounting or support device for the filling device of a centrifuge.

In accordance with an aspect of the present invention a mounting device is provided which includes a pair of generally semi-circular wing members having first and second opposite end portions. The wing members form an opening which surrounds the filling device in the centrifuge and the first end portions are flat and have aligned holes therein so that the wings can be pivotally connected on a mounting pin which is part of the structure of the centrifuge. The wings each have a plurality of radially inwardly extending resilient bumpers which engage the filling device to resist vibrations. A resilient ring is releasably and resiliently connected between the second end portions of the wings (the ends opposite the pivot connection therebetween) to resiliently engage the bumper pads with the filling device. These bumper pads resist and/or absorb vibrations in the filling device during operation of the centrifuge.

The above and other objects, features and advantages of this invention will be apparent in the following detailed description of an illustrative embodiment thereof which is to be read in connection with the accompanying drawings wherein.

Figure 1:
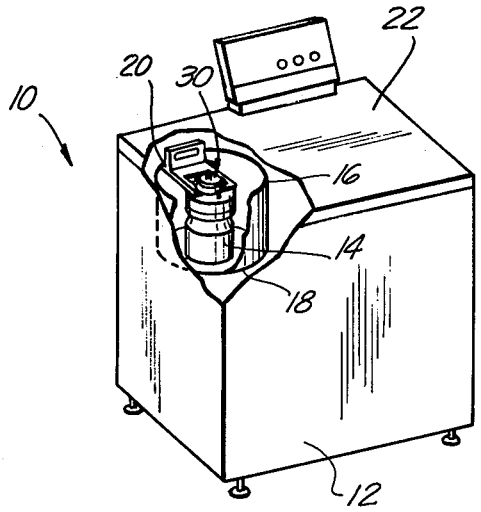
FIG. 1 is a perspective view, with parts broken away, of a centrifuge device including the mounting arrangement of the present invention.

Referring now to the drawings in detail, and initially to FIG. 1 thereof, a conventional centrifuge apparatus 10 is illustrated. The apparatus includes a housing 12 enclosing a rotor 14 below a stationary rotor shield 16. The shield 16 closes a rotor chamber 18 within which the rotor 14 operates from the top. The rotor shield includes a combination handle and bayonet latching member 20 mounted thereon in a fixed position for securing the filling device to the rotor shield and the rotor. As thus far described, the centrifuge 10 is of conventional construction.

Figure 2:
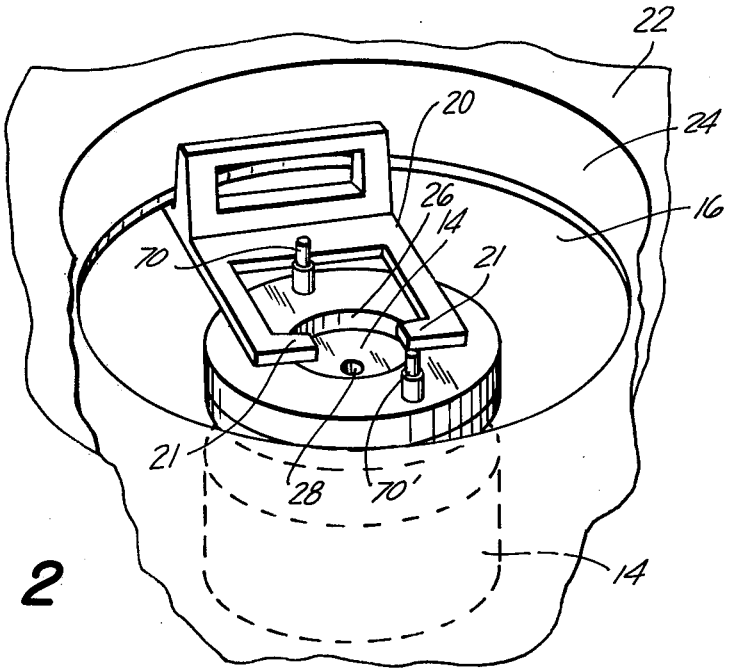
FIG. 2 is an enlarged partial perspective view through the top of the centrifuge in FIG. 1 showing the rotor element to which the filling device is attached.
Figure 4:
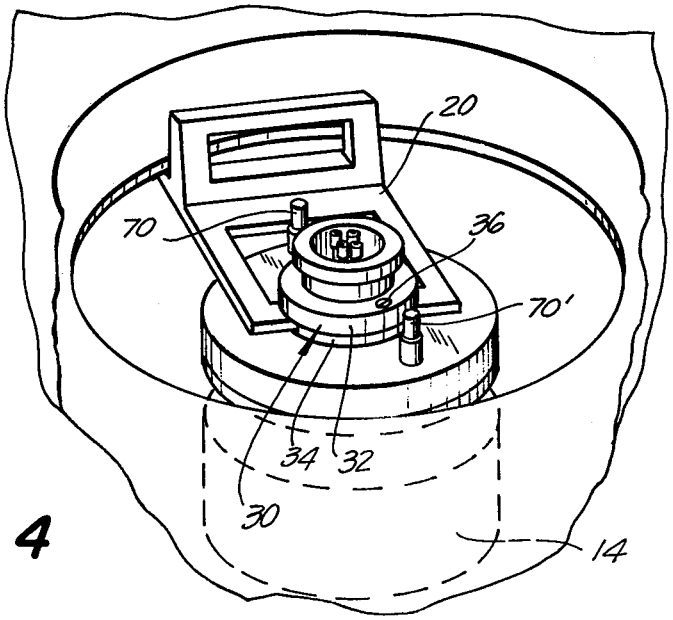
FIG. 4 is a perspective view similar to FIG. 2 showing the filling device mounted on the centrifuge in the conventional prior art manner.

As illustrated in somewhat greater detail in FIG. 2, the upper surface or panel 22 of centrifuge 10 includes an access opening 24 therein which exposes the combination handle and bayonet latching member 20 to view. That latching member is mounted on the generally cylindrical rotor shield 16 in any convenient manner.

The shield 16 also has an access opening, 26, formed therein to expose rotor 14, and the latter has an opening 28 formed therein through which the specimen to be centrifuged is supplied and withdrawn.

Figure 3:
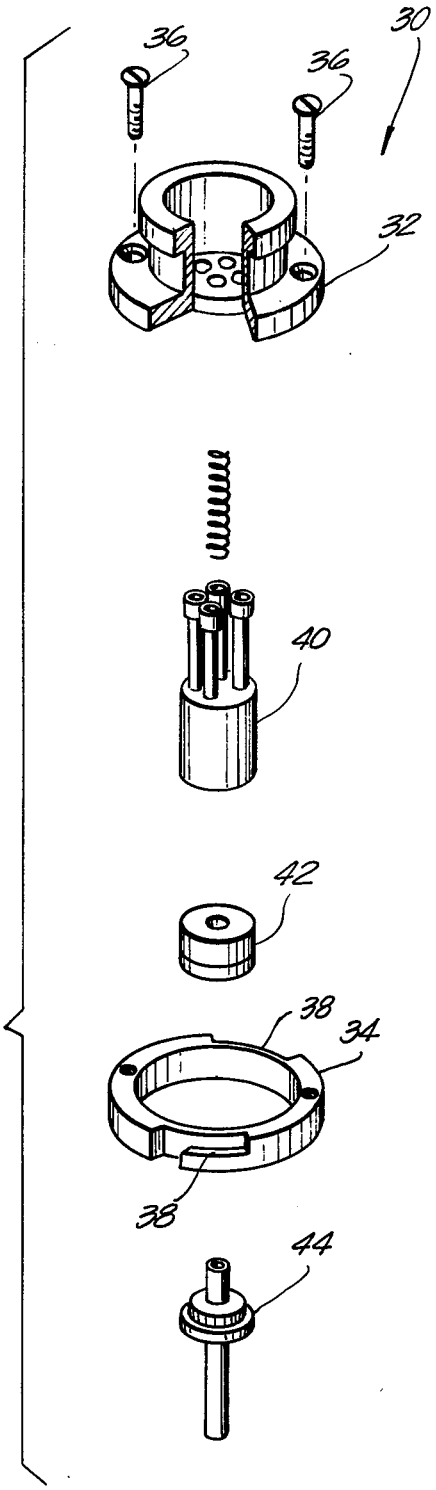
FIG. 3 is an exploded perspective view of a filling device adapted to be used with the centrifuge of FIGS. 1 and 2.

The filling device 30 for the centrifuge 10 is illustrated in FIG. 3. The filling device includes a pair of rigid ring members 32 and 34 which are secured together by screws 36 or the like. Ring 34 has female bayonet latch recesses or ramps 38 formed therein in a conventional manner.

Rings 32, 34 provide mounting support in the conventional manner for the feed connection 40 and its associated rotatable bearing or seal 42 through which the specimen is supplied from the connection 40 to rotor 14.

In conventional operation, feed device 30 is mounted in the centrifuge by engaging the radially opposed tongs 21 of the combination bayonet latch and handle 20 in the ramp sections 38 of plate 34. This holds the feed device in a relatively fixed position adjacent access opening 26 of rotor shield 16. In this position, rotatable seal 42 engages access opening 28 of rotor 14 to form a fluid-tight seal therebetween. In this manner, the specimen to be centrifuged can be supplied through feed connectors 40 and seal 42 to the rotor. In certain cases, and with certain types of centrifuge rotors, a separate transfer shaft 44 is connected to the rotatable seal 42 and extends into rotor 14. This transfer shaft is needed for placing the filling device on a "Z-60" type rotor which is available from Beckman Instruments.

This transfer shaft significantly prolongs the longitudinal axis of the filling device and thus causes a magnification of the vibrations transferred from the running rotor into the filling device. Such vibrations can result in leakage of the specimen being centrifuged into the environment.

Figure 5:
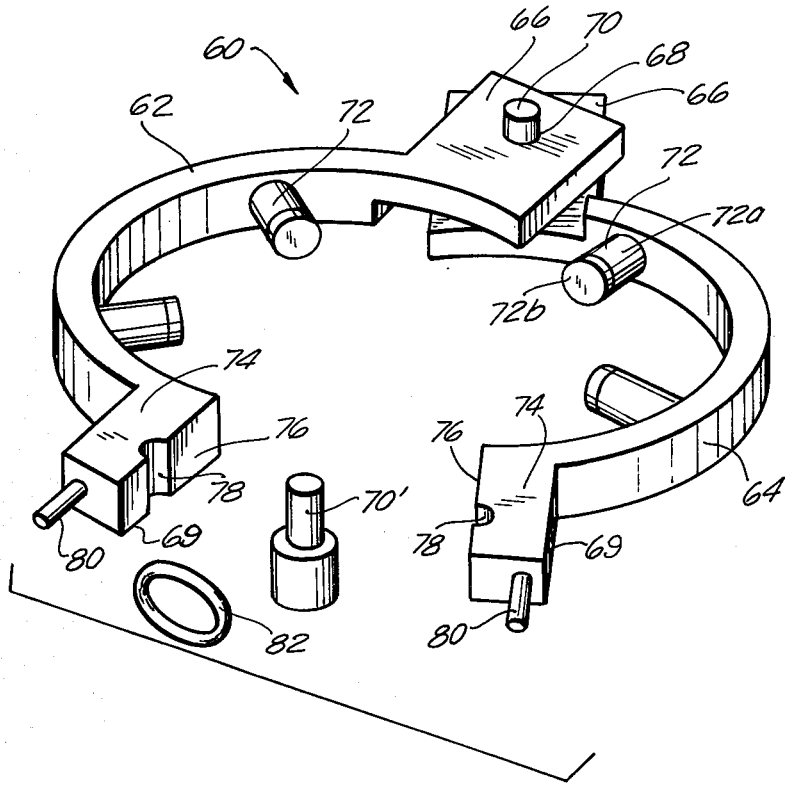
FIG. 5 is an enlarged perspective view of the mounting device of the present invention.

The mounting arrangement of the present invention serves particularly to resist such vibrations. This mounting arrangement is illustrated in detail in FIGS. 5 and 6, wherein it is seen that the mount 60 includes a pair of wings or tong arms 62 and 64 that have opposite ends 66 and 68 formed therein. The ends 66 of tongs 62, 64 have a flattened configuration so that the ends can be placed in super-imposed, overlapping relationship to one another. These ends each include an aperture 78, which are aligned when the ends are overlapped and which are adapted to receive one of the posts 70 formed on rotor shield 16. By this arrangement, tong wings 62, 64 are pivotally connected to each other through pin 70.

Each of the wings 62, 64 is generally semi-circular in configuration and has two or more resilient bumper members or pistons 72 extending radially inwardly therefrom. In the illustrative embodiment of the invention, the bumper elements are formed as posts 72*a* of the same material as the wings 62, 64 (e.g. metal or any hard rigid plastic) having end portions 72*b* which are formed of a resilient material such as for example silicone. The wings are dimensioned to surround access opening 26 in rotor shield 16 and receive therebetween the filling device 30. Of course it is to be understood that other equivalent vibrations or shock absorbing devices such as damping piston arrangements may be used in lieu of the silicone bumpers illustrated.

Figure 6:
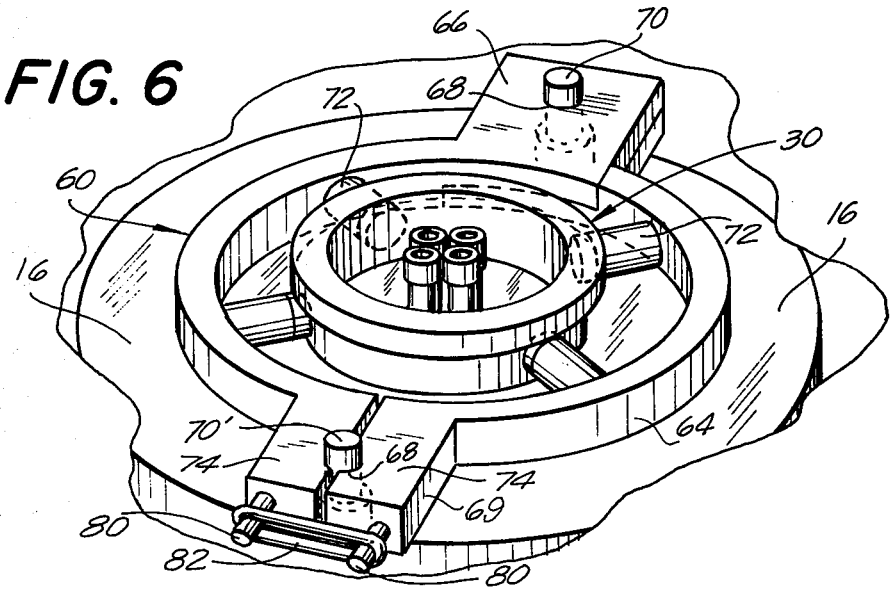
FIG. 6 is a perspective view showing the mounting device of the present invention in position in the centrifuge.

The opposite or second end portion 69 of wings 62, 64 have enlarged connecting arms 74 formed thereon. The inner surfaces 76 of these connecting arms have recesses 78 formed therein which are adapted to surround a second post 70' on rotor shield 16 when the wings are pivoted towards each other into the position shown in FIG. 6. In addition, arms 74 include outwardly extending pins 80, which cooperate with a resilient ring or band 82, as seen in FIG. 6, to resiliently hold the wings in their closed position. In this position the bumper members 72 engage filling device 30, as seen in FIG. 6, in a resilient manner, while the mounting device itself is fixed to rotor shield 16, due to the engagement of the wings with the pins 70, 70'. Yet, the wings can be readily easily released, in order to permit rapid removal or replacement of the filling device. This mounting arrangement will resiliently resist vibrations of the filling device during operation of the rotor.

Although an illustrative embodiment of the present invention has been described herein with reference to the accompanying drawings, it is to be understood that the invention is not limited to that precise embodiment, and that various modifications may be effected therein by one skilled in the art without departing from the scope or spirit of this invention.

What is claimed is:

1. A mounting for reducing vibration in the filling devices of centrifuges comprising a pair of wings of predetermined configuration including means for cooperating with a support post on a rotor shield of a centrifuge to pivotally connect the wings together on the post and define a space therebetween adapted to receive the filling device of the centrifuge, said wings each having a plurality of radially inwardly extending resilient bumpers having resilient free ends adapted to engage said filling device to resist vibrations therein, and means for resiliently and releasably connecting said wings together thereby to resiliently engage said bumpers with said filling device.

2. A mounting device as claimed in claim 1 wherein said wings are generally semicircular in plan, said wings each including first end portions adapted to be positioned in overlapping relationship and said means for cooperating with the support post of the centrifuge comprising through holes in said first end portions to receive said support post on the centrifuge pivotally connecting the wings together.

3. A mounting device as defined in claim 2 wherein each of said wings includes second end portions located opposite said first end portions said second end portions of said wings include outwardly extending pins and said connecting means comprises a resilient ring engaged between said pins.

4. A mounting device as defined in claim 3 wherein said second end portions of the wings have opposed semicylindrical vertically extending recesses formed therein for receiving therebetween a second support post in the centrifuge.

5. A mounting for reducing vibration in the filling devices of centrifuges comprising a pair of generally semicircular wings having first and second opposite end portions, said first end portions being flat and having cooperating means comprising aligned holes therein for receiving a mounting pin on the centrifuge whereby the wings are pivotally connected by the mounting pin in the centrifuge to define therebetween a generally circular space for receiving the filling device of the centrifuge, said wings each having a plurality of radially inwardly extending resilient bumpers having resilient free ends adapted to engage said filling device to resist vibrations therein, and resilient means for releasably and resiliently connecting the second end portions of said wings together thereby to resiliently engage the bumpers with the filling device.

6. A mounting device as defined in claim 5 wherein said second end portions of said wings include outwardly extending pins and said connecting means comprises a resilient ring engaged between said pins.

7. A mounting device as defined in claim 5 wherein said second end portions of the wings have opposed semicylindrical vertically extending recesses formed therein for receiving therebetween a second mounting pin in the centrifuge.

* * * * *